US007004773B1

(12) United States Patent
Poh et al.

(10) Patent No.: US 7,004,773 B1
(45) Date of Patent: Feb. 28, 2006

(54) ELECTRICAL CONNECTOR SOCKET WITH LATCH MECHANISM

(75) Inventors: Edmund Poh, Lisle, IL (US); Rok Meng Goh, Singapore (SG); Poh Teck Lim, Floravale (SG); James L. McGrath, Bloomingdale, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/217,245

(22) Filed: Sep. 1, 2005

(51) Int. Cl.
*H01R 13/62* (2006.01)

(52) U.S. Cl. ..... 439/160; 439/328

(58) Field of Classification Search ..... 439/157–160, 439/326–328
See application file for complete search history.

(56) References Cited

U.S. PATENT DOCUMENTS 5,389,000 A 2/1995 DiViesti et al.
5,569,043 A * 10/1996 Liu ..... 439/326
5,584,705 A 12/1996 Lin
5,690,499 A 11/1997 Howell et al.
5,746,613 A * 5/1998 Cheng et al. ..... 439/157
6,461,169 B1 10/2002 Harrison et al.
6,695,630 B1 2/2004 Ku
6,824,407 B1 * 11/2004 Zhao et al. ..... 439/157
6,932,633 B1 * 8/2005 Tsai ..... 439/160

* cited by examiner

*Primary Examiner*—Hien Vu
(74) *Attorney, Agent, or Firm*—Robert J. Zeitler

(57) ABSTRACT

An electrical connector for receiving a daughter card having a plurality of conductive surfaces, the electrical connector has a socket with an elongated slot for receiving the daughter card. The slot has electrical terminals for engaging the plurality of conductive surfaces on the daughter card and for electrically connecting the daughter card to the connector. A shaped tower at, at least one end of the elongated slot having a pair of legs rotatably retains a latch for securing the daughter card to the connector. The latch is rotatable between a first position at which the daughter card is retained within the elongated slot and a second position at which the daughter card is unrestrained. The connector further has an end wall at, at least one distal end of the elongated slot. The end wall has a protrusion protruding towards the centre of the elongated slot, the protrusion prevents the latch being removed from the tower when the latch is in the first position.

4 Claims, 4 Drawing Sheets

ELECTRICAL CONNECTOR SOCKET WITH LATCH MECHANISM

FIELD OF THE INVENTION

The present invention relates to electrical connectors, particularly to electrical connectors for printed circuit boards, and has application to printed circuit board connectors, which provide a retentive force using a latch mechanism.

BACKGROUND OF THE INVENTION

The invention has application to the electrical interconnection of modules, such as Single In-line Memory Modules Memory Modules (SIMM) to a motherboard. The sockets used for interconnecting are typically formed to include an elongated slot and a plurality of electrical terminals coupled to the socket housing. When a daughter card is inserted into the slot the terminals engage conductive surfaces on the daughter card so that the daughter card and motherboard are electrically connected. In order to prevent the daughter card from dislodging from the socket it is known to provide a retention mechanism.

U.S. Pat. No. 5,389,000 to DiViesti et al describes a connector for an edge card which includes a plurality of contact terminals spaced apart in an elongated connector housing. The latch/eject mechanism is rotatably disposed at an end of the connector housing. The latch/eject member operates between a first operative position wherein it latches the edge card in place within the connector housing and a second operative position wherein it at least partially ejects the edge card out of the connector housing. The latch/eject member is limited in its rotation during ejection of the edge card by one or more interference surfaces formed in the latch/eject member which engage a portion of the connector housing during ejection.

U.S. Pat. No. 5,569,043 to Liu describes an electric connector including a housing having a groove for engaging with a daughter card and having a casing and a beam extended from the end. A pair of latch members each includes a pair of resilient and spaced legs for being force-fitted in the casings. The latch members each include a projection having a tapered surface for allowing the daughter card to be moved over the projection and each includes another projection having a stop for engaging with the beam so as to prevent the latch members from being deformed. The latch members may apply a force against the daughter card so as to resiliently and stably retain the daughter card in place.

U.S. Pat. No. 5,584,705 to Lin describes an electric connector including an insulated seat and multiple pairs of terminals fixably mounted therein. Each terminal has a V-shaped bent contact portion at an inner side thereof and an S-shaped bent portion at a lower end thereof, which is connected to a leg for insertion into a circuit board and projecting therefrom. The configuration of the contact portion and bent portion of the terminal provides a greater resilience and a greater force for holding an insertable card in the seat. The electric connector further has a couple of hooks disposed at opposite ends thereof. The hooks are pivotally connected to the seat by means of pins. Each hook is provided with a push portion at a lower end thereof and a retaining portion at an upper end thereof, such that when an insertable card is plugged into the seat, the hook may retain notches in the sides of the card to enhance the gripping effect. The card may be easily removed from the seat by pressing an upper end of the hook so that the push portion pushes the card upwardly to disengage from the seat.

U.S. Pat. No. 5,690,499 to Howell et al describes an electrical socket has a slot for receiving an edge of a circuit card and an extractor which is movable for dislodging the circuit card from the slot. The socket has a pair of flexible towers, and the extractor has a pair of lateral projections, which are received in notches in the towers for locking the extractor in a closed position. The projections have beveled surfaces, and the towers have complementary ramps, which are engaged by the beveled surfaces so that the towers are resiliently deflected without damage to the projections.

U.S. Pat. No. 6,461,169 to Harrison et al describes an interconnected circuit module and motherboard use an electrical edge connector with conductive polymer contacts. The circuit module has electrical terminals along an edge of a front surface, and the electrical terminals extend to plated cylindrical grooves that are formed in the edge surface of the circuit module. The electrical edge connector is fastened to a surface of the motherboard and receives the edge terminals of the circuit module. When the circuit module is secured in the edge connector, the conductive polymer contacts are aligned with the cylindrical grooves of the circuit module and compressed against a land grid array on the surface of the motherboard. The connector is able to transmit electrical signals between the circuit module and the motherboard without the used of electrical pin connections.

U.S. Pat. No. 6,695,630 to Ku describes a connector assembly for a memory module includes a body having two standing pivot seats and two fasteners pivotally connected to the two pivot seats respectively. Each standing pivot seat has two recessed guides and two through pivot holes communicating with two recessed guides. Each fastener has a front and rear wall. Each front and rear wall has a protruding detent and a pivot pin. The protruding detents and the pivot pins correspond to the two recessed guides respectively. The pivot pins are inserted into the two through pivot holes when the fastener is mounted in the standing pivot seat so the fastener can pivot in the standing pivot seat to easily mount the memory module. In addition, the protruding detents press against the two recessed guides to hold the position of the fastener in the standing pivot seat, so the fastener can securely hold the memory module.

None of the above connectors provide a rotatable latch that is securely held in place while the daughter board is retained.

The present invention relates to card connectors and more particularly to a card connector having an improved latch/ejection mechanism.

SUMMARY OF THE INVENTION

An object of at least one embodiment of the invention is to provide an electrical connector for receiving a daughter card with a secure retaining mechanism.

In a first aspect the invention may be said to consist in an electrical connector for receiving a daughter card having a plurality of conductive surfaces, said electrical connector having: a socket with an elongated slot for receiving said daughter card said slot having electrical terminals for engaging said plurality of conductive surfaces on said daughter card and for electrically connecting said daughter card to said connector; a shaped tower at, at least one end of said elongated slot, said tower having a pair of legs; a latch for securing said daughter card to said connector, said latch having two side walls and a bottom wall, a cavity being formed by the side walls and the bottom wall, and being rotatably retained between said legs of said shaped tower, said latch rotatable between a first position at which said daughter card is retained within said elongated slot and a second position at which said daughter card is unrestrained; and an end wall at, at least one distal end of said elongated slot, each said end wall having a protrusion protruding towards the centre of said elongated slot, said protrusion being located within the cavity when said latch is in the first position to prevent said latch being removed from said tower when said latch is in said first position.

The latch is preferably an open cubiod having two elongated sides, a top and a bottom, said bottom being secured under said protrusion when said latch is in said first position.

The electrical connector preferably at each end of said elongated slot has a shaped tower and end wall.

The invention may further be said to consist in any alternative combination of parts or features mentioned herein or shown in the accompanying drawings. Known equivalents of these parts or features which are not expressly set out are nevertheless deemed to be included.

BRIEF DESCRIPTION OF THE DRAWINGS

Disclosed embodiments and methods of utilizing the invention will be further described, with reference to the accompanying FIGS., by way of example only and without intending to be limiting, wherein.

DETAILED DESCRIPTION OF THE DISCLOSED EMBODIMENTS

Referring to the FIGS. it will be appreciated that the invention may be implemented in various forms and modes. The following description of the disclosed embodiment of the invention is given by way of example only.

Figure 1:
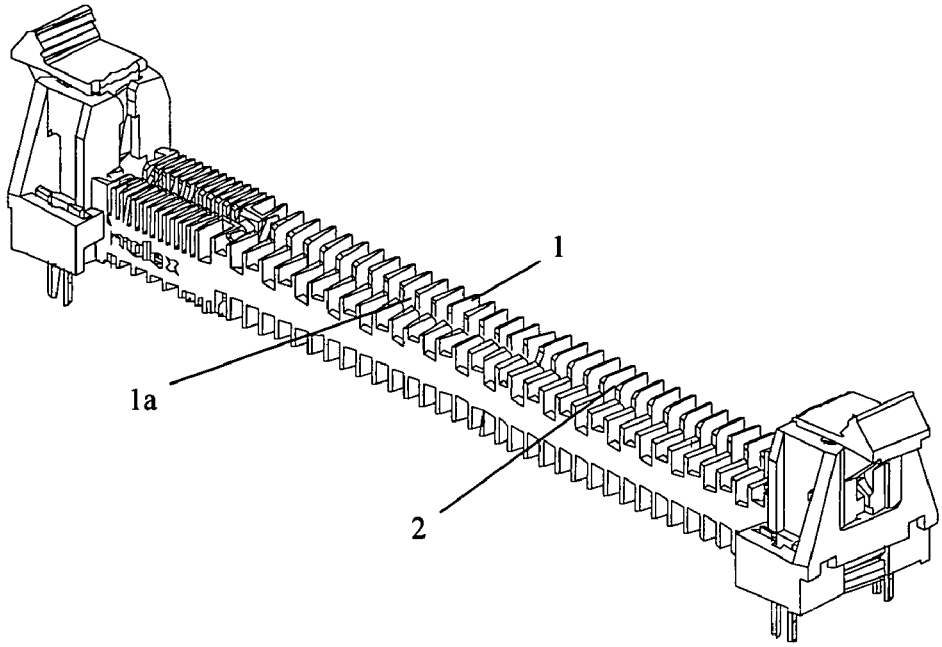
FIG. 1 is a perspective view of an empty connector of the present invention.
Figure 2:
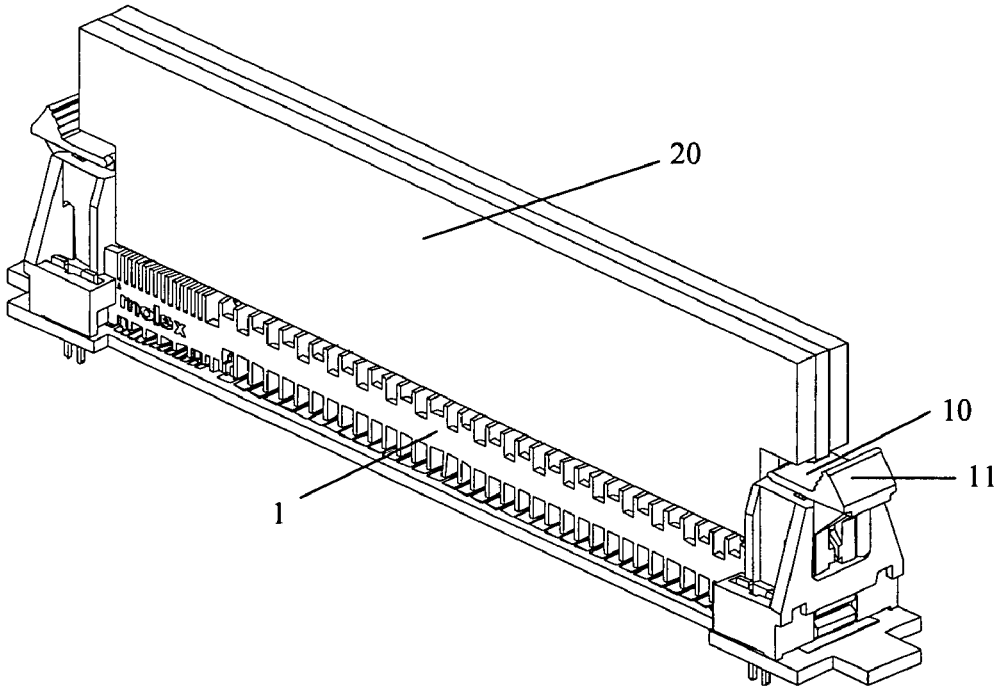
FIG. 2 is a perspective view of a connector of the present invention with a daughter card installed.
Figure 3:
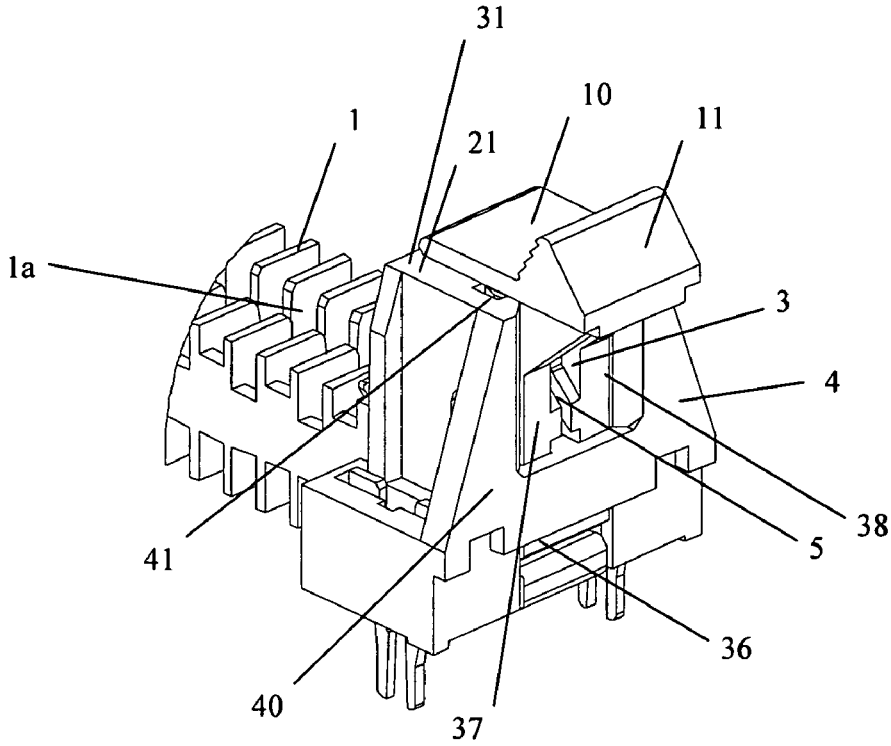
FIG. 3 is a perspective view of an end of the connector of the present invention with the retention device in a locked position.
Figure 4:
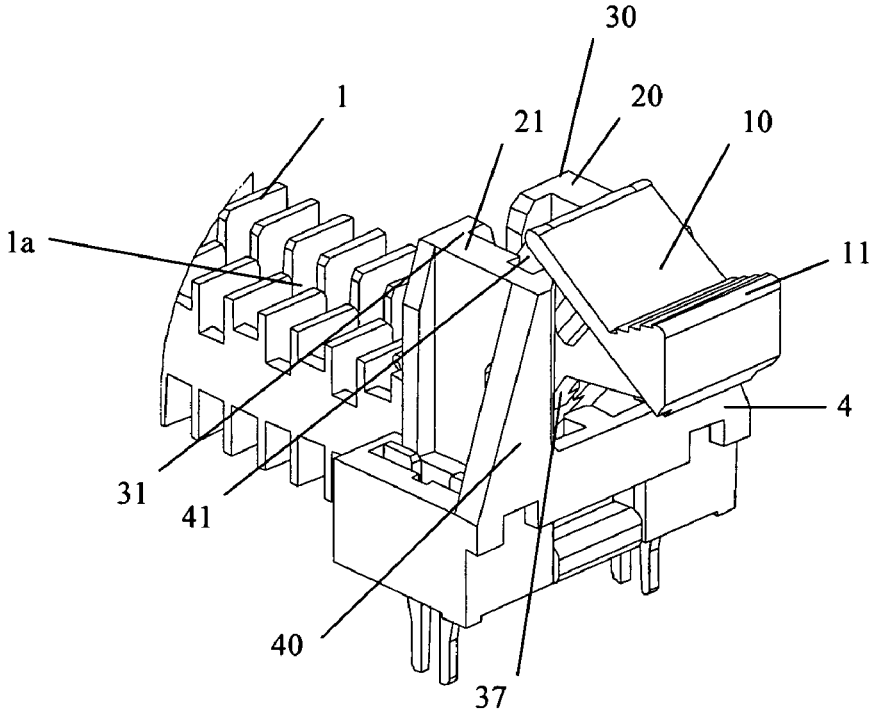
FIG. 4 is a perspective view of an end of the connector of the present invention with the retention device in an unlocked position.

Referring to the drawings FIGS. 1 and 2 illustrates the connector of the present invention. The connector or socket includes a housing 1 including an elongated slot 1*a* to receive a daughter card 20. A plurality of electrical terminals 2 are embedded in the housing for electrically connecting the daughter card 20 to another board. Referring to FIGS. 3 to 9 at each lateral end of the slot 1*a* is a U shaped tower 21 for supporting and retaining the daughter card 20 within the elongated slot 1*a*.

Each tower 21 has two legs 30 and 31 and includes a securing mechanism 10 for retaining a daughter card 20 within the elongated slot 1*a*. The securing mechanism, fastener or latch 10 is pivotally mounted between the two legs 30 and 31 of the tower 21. The latch 10 typically includes a pair of pivot pins (not shown) that engage in a pivot holes (not shown) within the slot 41 in each leg 30, 31 of the towers 21. The pivot pins and pivot holes are in the preferred embodiment all round, but may be shaped to limit the movement of the latch 10.

Figure 6:
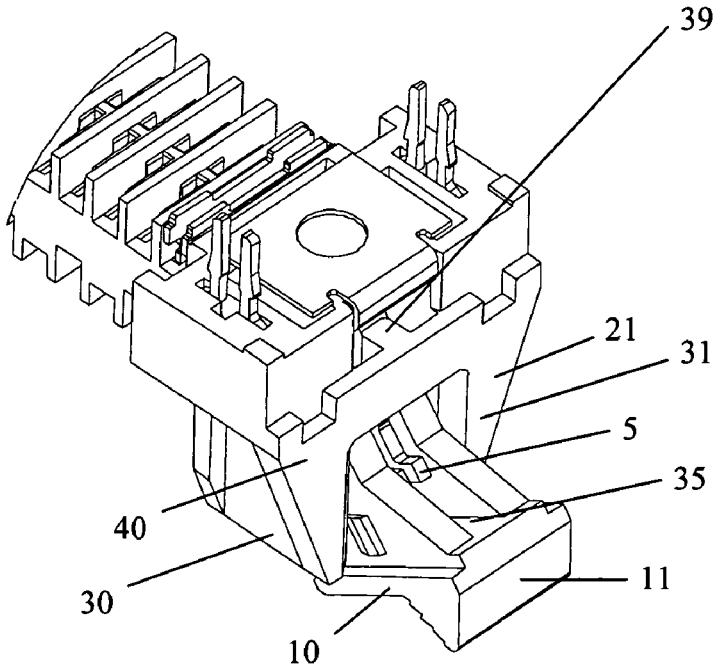
FIG. 6 is a bottom perspective view of an end of the connector of the present invention with the retention device in an unlocked position.
Figure 9:
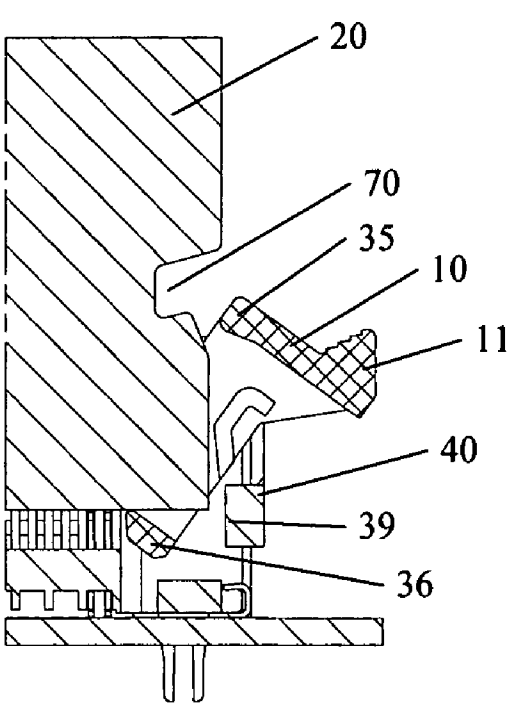
FIG. 9 is a cross section taken on the line z z of the connector of FIG. 7 with the retention device in an unlocked position.
Figure 8:
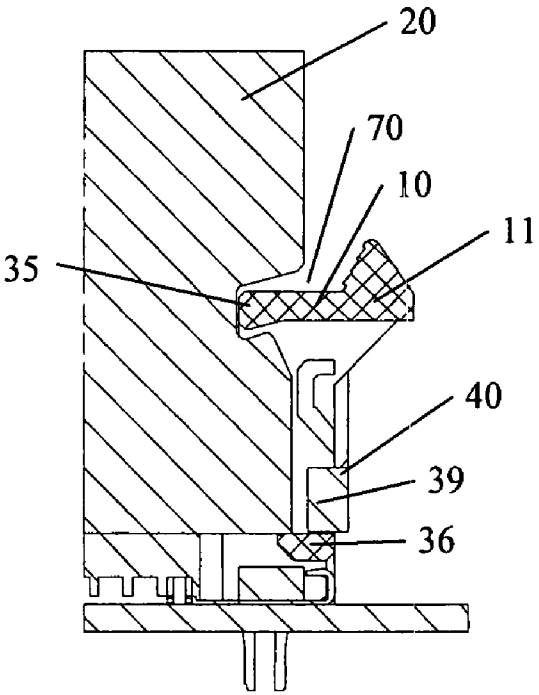
FIG. 8 is a cross section taken on the line z z of the connector of FIG. 7 with the retention device in a locked position.
Figure 7:
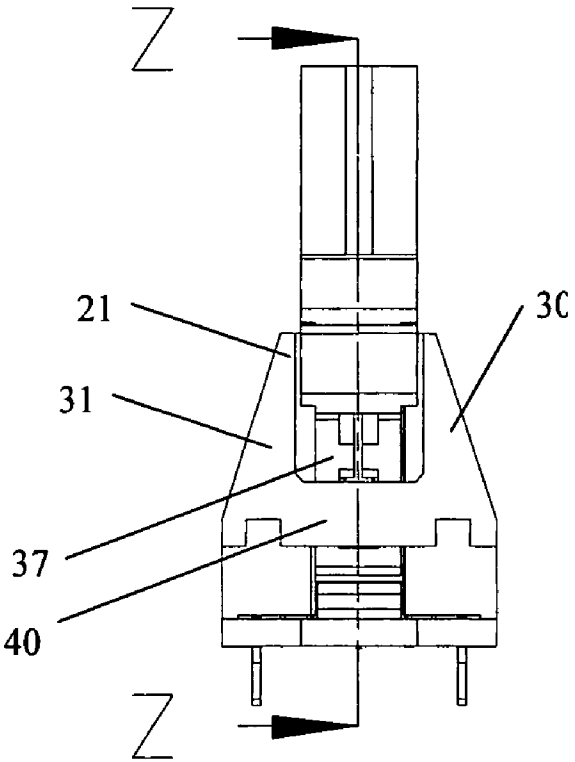
FIG. 7 is a end view of a connector of the present invention with a daughter card installed.

The latch 10 in a closed position seen in FIGS. 6 and 8 engages with a notch 70 on the daughter card 20 and secures the daughter card 20 within the slot 1*a*. In an open position seen in FIGS. 4 and 9 the latch 10 no longer secures the daughter card 20.

The latch 10 is an elongated open cuboid having two elongated sides 37, 38 a top 35 and a bottom 36. The latch 10 includes a tab 11 used for moving the latch 10 to an open position typically with a finger or thumb. The top 35 engages with the notch 70 on the daughter card 20.

At the distal ends of the slot 1*a* are end walls 40, protruding from each end wall 40 towards the slot 1*a* is a protrusion 39. The protrusion 39 is shaped to fit within a cavity in the latch 10 formed by the two sides 37, 38 and the bottom 36 of the latch. When the latch is moved to a closed, or first position, to retain the daughter card 20 in the connector, the protrusion 39 enters the cavity. The bottom 36 of the cavity limits upward movement of the latch due to interference with the protrusion 39.

Figure 5:
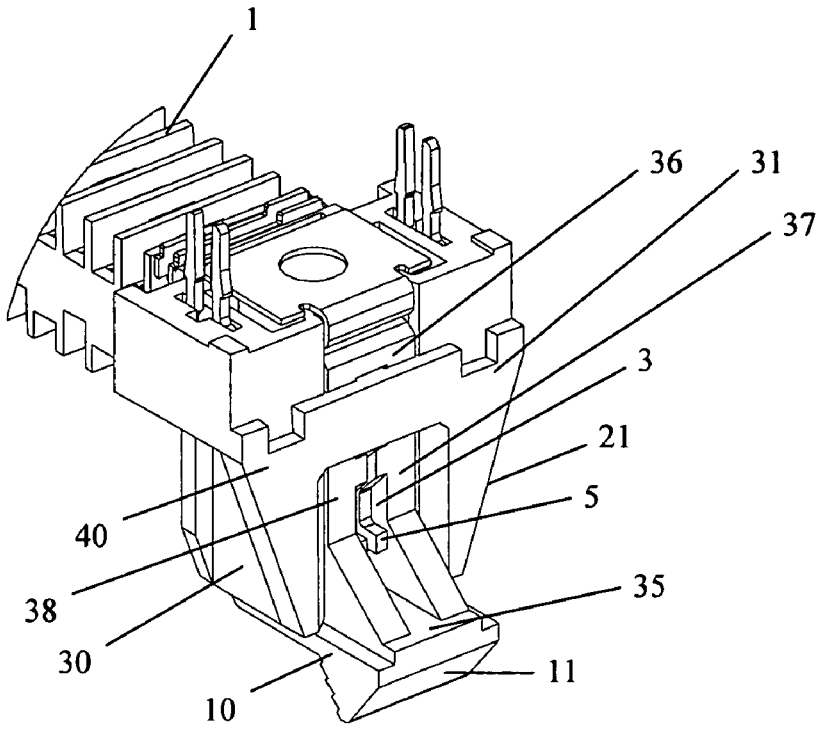
FIG. 5 is a bottom perspective view of an end of the connector of the present invention with the retention device in a locked position.

This arrangement helps to prevent the daughter card 20 and the two latches from being withdrawn from the socket when the latches 10 engage the daughter card 20. Without the bottom 36 being secured under the protrusion 39 it is possible to forcibly remove the daughter card 20 and the latches 10 by the application of force. Removal can happen because the pivot pins and holes are designed to allow for easy insertion of the pins within the holes. Such a design does however allow removal if forced. With the bottom 36 of the latch being secure under the protrusion 39, as can be seen in FIGS. 5 and 8, removal of the latch 10 is much more difficult, and would require significantly more force for removal.

The foregoing describes the invention with reference to the disclosed embodiment. Alterations and modifications as will be obvious to those skilled in the art are intended to be incorporated within the scope of the invention as defined in the accompanying claims.

What is claimed is:

1. An electrical connector for receiving a daughter card having a plurality of conductive surfaces, said electrical connector having:

a socket with an elongated slot for receiving, said daughter card said slot having electrical terminals for engaging said plurality of conductive surfaces on said daughter card and for electrically connecting said daughter card to said connector;

a U shaped tower at at least one end of said elongated slot, said tower having a pair of legs;

a latch for securing said daughter card to said connector, said latch having two side walls and a bottom wall, a cavity being formed by the side walls and the bottom wall, said latch rotatably retained between said legs of said U shaped tower, said latch rotatable between a first position at which said daughter card is retained within said elongated slot and a second position at which said daughter card is unrestrained; and an end wall at at least one distal end of said elongated slot, each said end wall having a protrusion protruding towards the centre of said elongated slot, said protrusion being located within the cavity when said latch is in the first position, said protrusion capable of interacting with said bottom wall of said latch to prevent said latch from being removed from said tower when said latch is in said first position.

2. An electrical connector for receiving a daughter card as claimed in claim 1 wherein said latch is an open cubiod having two elongated sides, a top and a bottom, said bottom being secured under said protrusion when said latch is in said first position.

3. An electrical connector for receiving a daughter card as claimed in claim 1 wherein each end of said elongated slot has a U shaped tower and end wall.

4. An electrical connector for receiving a daughter card as claimed in claim 2 wherein each end of said elongated slot has a U shaped tower and end wall.

* * * * *

UNITED STATES PATENT AND TRADEMARK OFFICE

CERTIFICATE OF CORRECTION

PATENT NO. : 7,004,773 B1
APPLICATION NO. : 11/217245
DATED : February 28, 2006
INVENTOR(S) : Edmund Poh et al.

It is certified that error appears in the above-identified patent and that said Letters Patent is hereby corrected as shown below:

On the title page item (75), The name of inventor, which currently reads "Rok Meng Goh," should read --Kok Meng Goh.--

Signed and Sealed this

Twenty-seventh Day of March, 2007

JON W. DUDAS
*Director of the United States Patent and Trademark Office*